United States Patent [19]

Wöhrle

[11] Patent Number: 4,637,338

[45] Date of Patent: Jan. 20, 1987

[54] SCRAPING APPARATUS

[75] Inventor: Albert Wöhrle, Heidenheim, Fed. Rep. of Germany

[73] Assignee: J. M. Voith GmbH, Fed. Rep. of Germany

[21] Appl. No.: 668,374

[22] PCT Filed: Mar. 29, 1984

[86] PCT No.: PCT/EP84/00088

§ 371 Date: Oct. 5, 1984

§ 102(e) Date: Oct. 5, 1984

[87] PCT Pub. No.: WO84/03847

PCT Pub. Date: Oct. 11, 1984

[30] Foreign Application Priority Data

Apr. 2, 1983 [DE] Fed. Rep. of Germany ..... 3311999

[51] Int. Cl.[4] ..... B05C 11/04

[52] U.S. Cl. ..... 118/126; 118/123

[58] Field of Search ..... 118/126, 119, 123, 261; 15/256, 51

[56] References Cited

U.S. PATENT DOCUMENTS

| | | | |
|---|---|---|---|
| 3,245,378 | 4/1966 | Caple et al. | 118/126 |
| 4,220,113 | 9/1980 | Wohlfeil | 118/126 |
| 4,309,960 | 1/1982 | Waldvogel | 118/665 |
| 4,335,675 | 6/1982 | Waldvogel | 118/126 |
| 4,375,202 | 3/1983 | Miller | 118/117 |

FOREIGN PATENT DOCUMENTS 1424150 2/1976 United Kingdom .

OTHER PUBLICATIONS

Wochenblatt fur Papierfabrikation 1980, pp. 781–783, by H. P. Frei.

Leonard Haas, Pulp & Paper International, Apr. 1976, pp. 67–69.

Wochenblatt fur Papierfbrikation 1980, pp. 271–276, by H. Ruckert.

*Primary Examiner*—John P. McIntosh

*Attorney, Agent, or Firm*—Ostrolenk, Faber, Gerb & Soffen

[57] ABSTRACT

An apparatus for scraping off excess coating composition from a traveling web of paper has a doctor, in the form of a flexible blade used as is or with a metering rod thereon. The doctor is fastened to a doctor supporting beam and can be pressed against the web of a paper by means of a supporting ledge which is fastened to the doctor supporting beam. The doctor supporting beam is swingably mounted at each of its two ends in a respective intermediate pivoting lever. Each intermediate lever is, in turn, pivotably mounted to a supporting bar. The pivoting axis of the intermediate levers lies as close as possible to the line of attack of the doctor on the web of paper. However, the pivoting axis of the doctor supporting beam is displaced from the pivoting axis of the intermediate levers. The end of the intermediate lever remote from its pivoting axis is connected by a pair of lift mechanisms to the doctor supporting beam. A spindle drive effects a joint swinging of the doctor supporting beam and the intermediate lever relative to both pivoting axes to maintain the doctor at a constant angle of attack relative to the web. The spindle drive and the two lift mechanisms can be coupled to each other.

12 Claims, 7 Drawing Figures

SCRAPING APPARATUS

FIELD OF THE INVENTION

The invention relates to a scraping device and particularly to an apparatus for scraping off of excess coating composition from a traveling web of material, for instance a web of paper, which is coated with the coating composition. The scraping is effected by means of a doctor which has an elastic blade. This doctor can be developed in two different forms. In one form, it consists exclusively of a elastic blade. In such case the free end of the blade itself is pressed against the web of material. In the other form the doctor is formed of a blade and a metering rod attached to the free end of the blade. In this case the metering rod is pressed against the web of material. In both cases the blade is deformed to a greater or lesser extent when pressed against the web of material.

The purpose of such a scraping apparatus is to obtain thickness of layer which is as uniform as possible upon the coating of a web of material with coating composition. The thickness of the layer is to be adjustable, for instance by changing the force with which the doctor is pressed against the web of material.

At the place where the excess coating composition is scraped off, the web of material can travel over a rotatable roll or over a stationary supporting device. Alternatively the web of material can travel between two symmetrically arranged scraping apparatus if it has been previously coated simultaneously on both sides.

PRIOR ART

1. Wochenblatt für Papierfabrikation 1980, pages 781 to 783;
2. Pulp & Paper International, April 1976, pages 67 to 69;
3. Federal Republic of Germany Pat. No. 24 35 527 which corresponds to British Pat. No. 1,424,150;
4. Wochenblatt für Papierfabrikation 1980, pages 271 to 276;
5. Federal Republic of Germany Pat. No. 28 25 907 which corresponds to U.S. Pat. No. 4,220,113;
6. Federal Republic of Germany Unexamined Application for Patent OS No. 30 17 274 which corresponds to U.S. Pat. No. 4,375,202;
7. U.S. Pat. No. 4,309,960;
8. Federal Republic of Germany Pat. No. 29 31 800 which corresponds to U.S. Pat. No. 4,335,675.

From FIG. 3 of Reference 1 it can be noted that the blade, which is deformed under the pressing pressure, forms at its tip the so-called blade working angle with the web of material. Requirement is made of all scraping apparatuses of the type in question here that this blade working angle remain unchanged when the application force is varied. This is important for the following reasons:

(a) If the blade is itself pressed against the web of material, then the blade has at its tip a diagonally ground blade scraping surface. From FIG. 6 of Reference 1 it can be noted that this blade scraping surface must be always parallel to the surface of the web. If only an edge of the blade is pressed against the traveling web the quality of the coating suffers.

(b) If the blade bears a metering rod at its tip, it must be seen to it that the metering rod rests, as is known, in a doctor bed. Thus there would be the danger of the doctor bed coming into contact with the traveling web if the blade working angle were to change upon a change in the application pressure.

The various designs known from the above-mentioned references all have the features in common that the doctor supporting beam can be swung around a first swivel axis which extends transverse to the direction of travel of the web as close as possible to the line of attack of the doctor on the web of material. This swingability is necessary in order to be able to vary the basic adjustment of the doctor so as to effect adaptation to different types of webs, coating compositions or types of doctors. The aforementioned blade working angle thus results from this basic adjustment and the application force applied.

The requirement indicated above that the blade working angle be maintained unchanged upon a change in the application pressure is satisfied in the known designs by means of completely different measures and with varying degree of success.

In the known apparatus in accordance with References 1 to 3, the doctor supporting beam has an additional axis of swing (D)—as seen in cross section—between the point of attack of the doctor on the traveling web and the point of attack of the supporting ledge on the blade. (The supporting ledge is arranged in that case on an extension of the blade clamping device). If the doctor supporting beam is swung around this additional swivel axis, then the application force changes (with deformation of the blade), and the blade working angle remains constant. This favorable effect, however, is present—upon operating only with the blade, i.e. without metering rod—only as long as the blade is not worn or only slightly worn. Wear of the blade is unavoidable in all blade scraping apparatus; the life of a blade is, in general, between about one hour and ten hours. The apparatus known from References 1 to 3, therefore, has the disadvantage that after a given amount of wear of the blade the blade working angle no longer remains constant to the desired extent upon variation of the application force. One is thus compelled to replace the worn blade with a new blade earlier than would otherwise be necessary. Another disadvantage of this known apparatus is that when the blade has already become worn to a certain extent the doctor supporting beam—in order to increase the application force by a certain amount—must be swung to a larger angle (around the said additional swivel axis D) than in the case of a new blade. In other words, the range of adjustment of the application force is too small in said case.

From Reference 2 the design of the known apparatus can be noted: The doctor supporting beam is supported at both ends in an eccentric disk. The axis of this support is the above-mentioned additional swivel axis (D). Each of the eccentric disks is mounted in a support. The axis of this mount is the aforementioned first swivel axis which lies as close as possible to the line of attack of the doctor on the web of material.

In another known design in accordance with References 4 and 5, the supporting ledge is fastened to the doctor supporting beam while an additional beam displaceable in the blade supporting beam is arranged as clamping device for the blade. The plane of displacement and the plane determined by the unstressed blade form an acute angle. From FIGS. 8 and 9 on page 273 of Reference 4 it can be noted that upon such a displacement of the blade clamping device, while there is the advantage that the application force can be adjusted within a relatively large region, there is the disadvantage that the blade working angle does not remain precisely the same. At least upon a strong change in the application force there is also a certain change in the blade working angle.

The latter is also true in the case of the further design known from Reference 6; see FIG. 1. The blade clamping device in that case is not displaceable along a plane but swingable around an additional axis.

In the known design shown in Reference 7, the supporting ledge (6) is arranged on an additional beam (8) which is swingably fastened on the doctor supporting beam. The varying of the application force is effected in that case by swinging the supporting ledge and by the change in shape of the blade which thus takes place. In order for the blade working angle to remain constant upon such a variation of the application force, the following measures are taken in that case: The drive for the swing means of the doctor supporting beam can be actuated by a control device as a function of the change in shape of the blade, this being done to such an extent that the blade working angle remains unchanged. This design, it is true, can, in principle, satisfy the above-indicated requirement (constancy of the blade working angle upon variation of the application force). However it is also disadvantageous in many cases that the after-swinging of the doctor supporting beam upon a change in shape of the blade takes place with a certain delay.

In the last known design according to Reference 8, in order to change the application force of the blade the entire doctor supporting beam (6), together with its supporting bars (9) arranged on both sides, are displaced by small amounts relative to the counter-roller. In this case the supporting bars (9) are swung around a swivel axis (10) which is arranged at a large distance from the blade. One disadvantage of this design is that in this case the aforementioned first swivel axis of the doctor supporting beam is also displaced, which axis should be as close as possible to the line of attack of the doctor on the web of material. This last-mentioned requirement can therefore not be continuously satisfied in the case of the design according to Reference 8. Furthermore, there is no means for holding the blade working angle constant upon a variation of the application force. (For this purpose one could use the above-described control device known from Reference 7).

DESCRIPTION OF THE INVENTIVE SOLUTION

The object of the invention is to provide a scraping apparatus having the features that—while retaining the feature that both the supporting ledge and the blade clamping device are rigidly fastened to the doctor supporting beam—the scraping apparatus permits the most accurate possible, delay-free constancy of the blade working angle upon variation of the application force, even if the application force is varied within a very large range and even if the blade is relatively severely worn. In other words, the object of the invention is to satisfy simultaneously and jointly the following requirements:

1. The blade working angle should be held as constant as possible upon variation of the application force.

2. When operating with the blade alone (without metering rod) it should be possible to operate even with a blade which is already severely worn; i.e., the useful life of the blade should be as long as possible.

3. The application force is to be variable within a range which is as large as possible, even when the blade is already worn.

4. The simple construction of the known doctor supporting beam with supporting ledge and blade clamping device rigidly fastened thereto is to be retained.

Additional requirements will be explained further below.

The adjustability of the doctor supporting beam (transverse to the lengthwise direction of the blade) makes it possible to vary the application force of the doctor against the web. To this extent there is a similarity to the known construction in accordance with Reference 8. Differing from it, however, in the case of the present invention the said displacement of the doctor supporting beam takes place without swinging of the support rods; i.e., the position of the first swivel axis of the swivel supporting beam, which axis coincides as accurately as possible with the line of attack, remains stationary.

Another step which is necessary to achieve the intended purpose is the coupling of the swing drive (for the swinging of the doctor supporting beam around the said first swivel axis) and the setting drive (for the displacement of the doctor supporting beam. This coupling need not necessarily be of a mechanical nature (although this is preferred). Rather, an electrical coupling of two separate drive motors is also conceivable. The decisive factor is merely that upon a variation of the application force (of the doctor against the traveling web) both drives are jointly active so that the doctor supporting beam carries out a combined movement (brought about by the two drives).

It is merely necessary now to adapt the speeds of the two individual movements to each other in such a manner that a change in the application force by a precisely defined amount is coupled with a swinging of the doctor supporting beam through a precisely defined angle. In other words, the two individual movements are so adapted to each other that the blade working angle remains completely unchanged upon a change in the application force.

As already mentioned, the first swivel axis of the doctor supporting beam always remains stationary, regardless of what application force is set. In this way there is retained the advantage of the design known from References 1 to 3 that for any adjusted application force the blade working angle can—if necessary—be changed (by swinging the doctor supporting beam around the first swivel axis) without the application force being changed thereby.

One important feature of the design known from References 1 to 3 is that only one of the two possible swinging movements of the doctor supporting beam can take place at the same time, namely either around the first swivel axis lying in the line of attack of the doctor or around the said additional swivel axis D. The combined movement of two simultaneous individual movements provided instead of this, according to the invention, now makes it possible to change the speed ratio of the two individual movements, preferably as a function of the degree of wear of the blade (if one operates without metering rod). In this way it is possible to utilize the advantage of constancy of the blade working angle upon variation of the application force, not only in a new blade but also when the blade has become substantially worn. This extremely favorable property is not possessed (to the best of the knowledge of the applicant) by any of the numerous known designs.

As compared with References 1 to 3 the invention offers a further advantage. The range of adjustment of the application force is relatively large even if the blade is already extensively worn.

As compared with the designs known from References 4 to 7 the construction according to the invention has, inter alia, the advantages that neither the supporting ledges nor the blade clamping device need be made movable relative to the doctor supporting beam and that the blade working angle is maintained constant (upon adjustment of the application force) with greater accuracy and without time delay.

Other inventive developments of the invention described above will be described below on basis of embodiments with reference to the drawings.

FIGS. *2a, 2b* and *2c* show, in a diagrammatic side view, the course of movement of the doctor supporting beam upon displacement of the application force.

Figure 3:
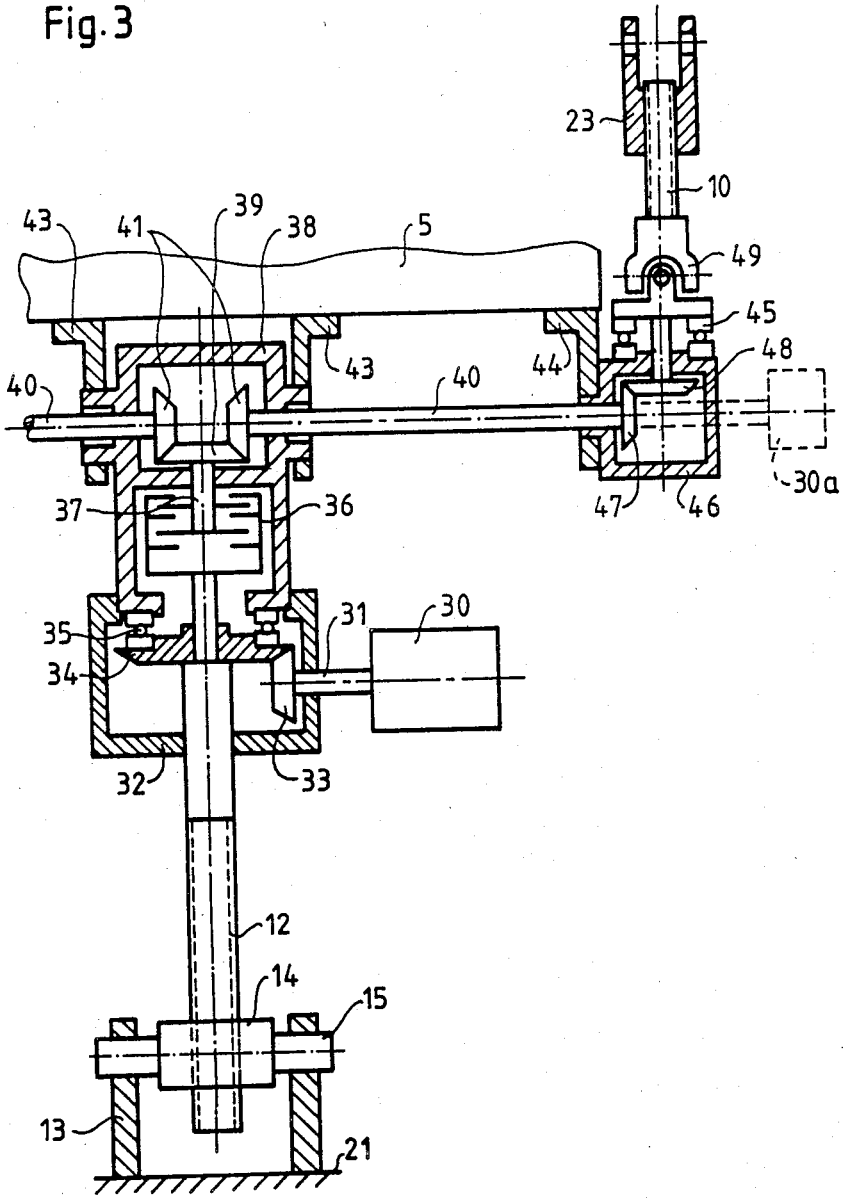

FIG. 3 shows a drive diagram for the spindle lifting mechanisms.

Figure 1:
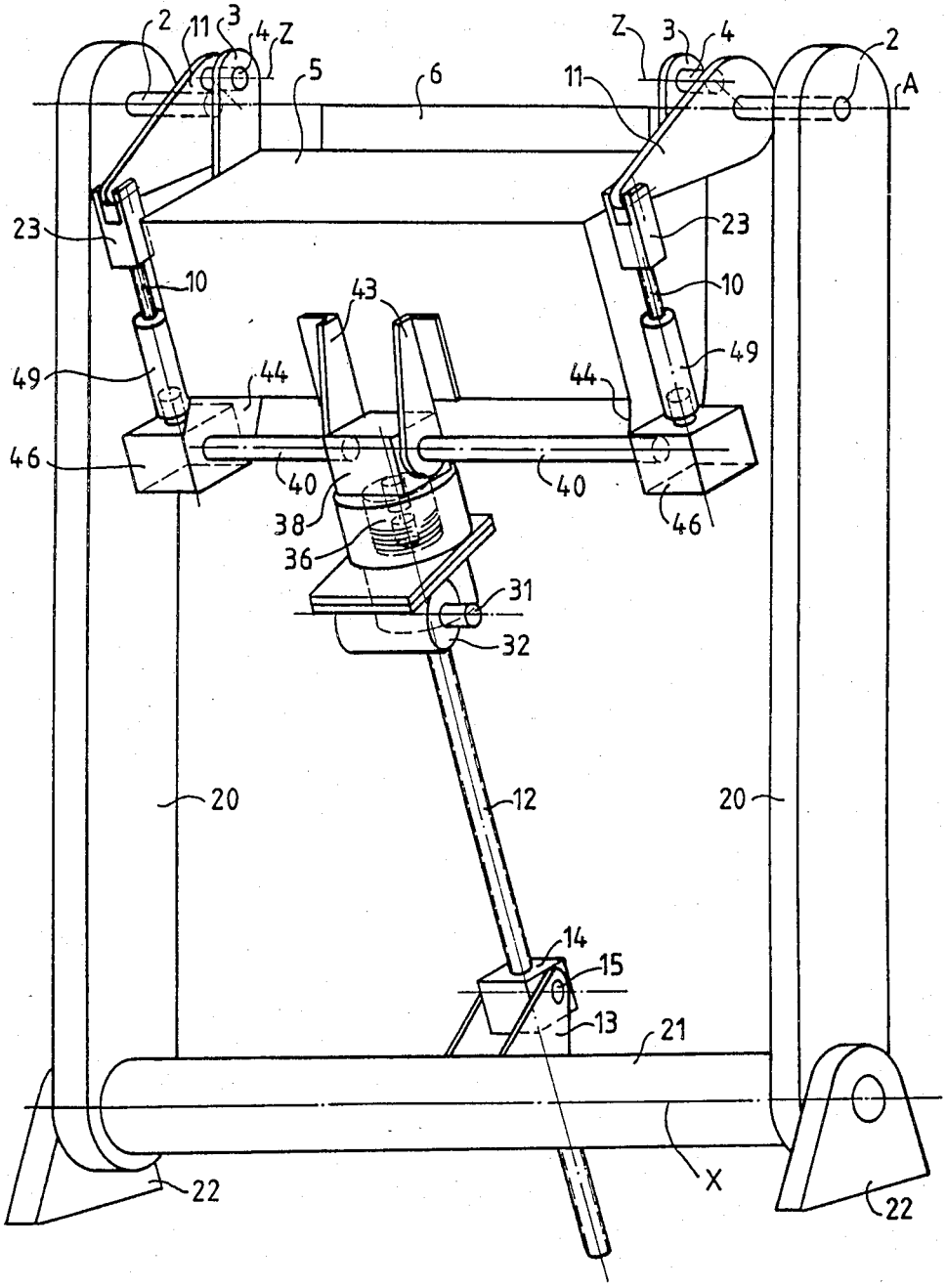
FIG. 1 shows a scraping apparatus in oblique view.
Figure 4:
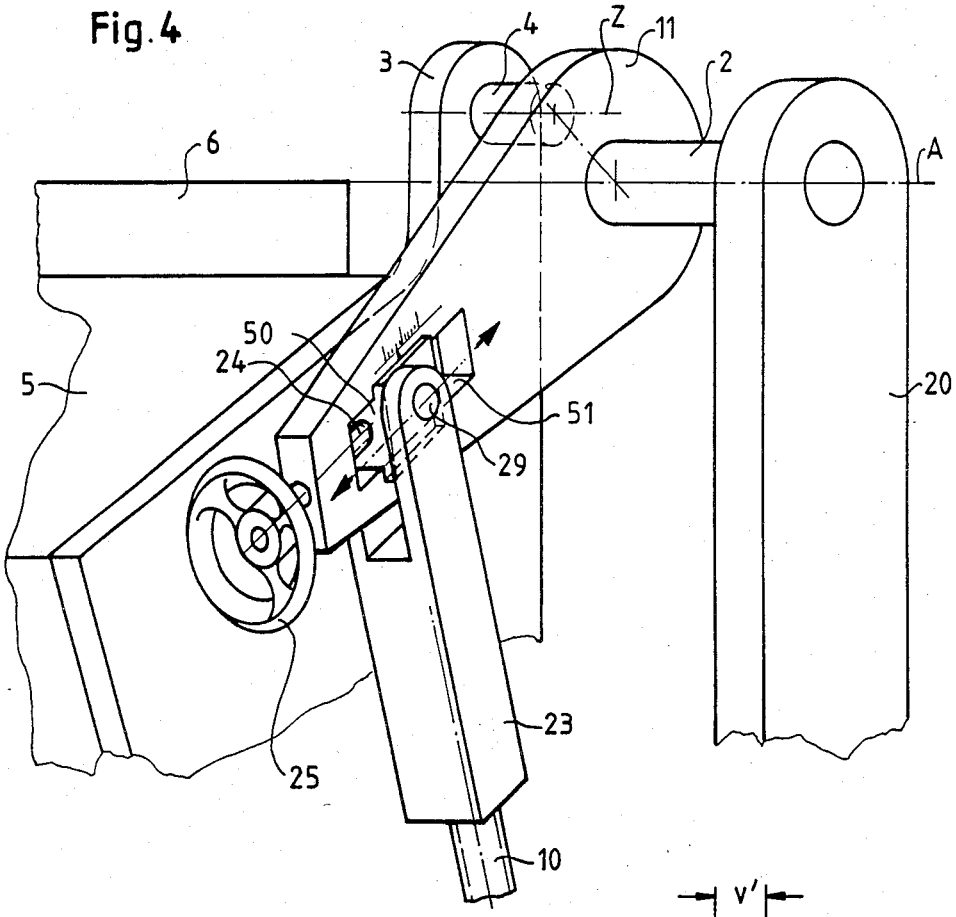

FIG. 4 shows a detail of FIG. 1, on a larger scale.

Figure 5:
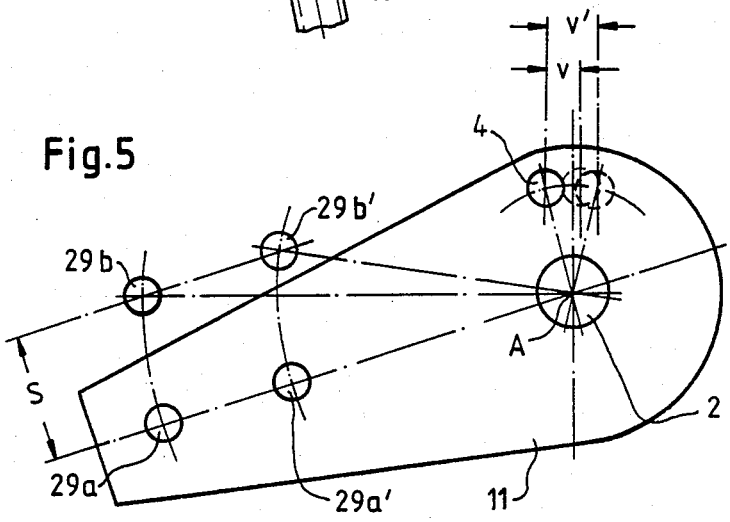

FIG. 5 is a diagrammatic side view of the detail shown in FIG. 4.

DETAILED DESCRIPTION OF THE INVENTION

The important individual parts of a scraping apparatus according to the invention can be noted from FIGS. 1 and *2a*. Two supporting bars 20 are connected rigidly to each other by a connecting tube 21 and mounted for swinging around a swivel axis X in bearing brackets 22. In operating position, the supporting bars 20 extend approximately vertically upward. At their upper ends they each have a journal pin or trunnion 2 or, more generally, a swivel bearing 2. A doctor supporting beam 5 is supported therein in a manner which will be described in detail further below.

In FIG. *2a* a small piece of the outer surface of a counter roller is indicated by a line C provided with a hatching. This roller has been omitted in FIG. 1; it rotates in the direction indicated by the arrow P (FIG. *2a*) and in this connection conducts obliquely upward a web of paper which has been coated with a coating composition on its lower side. By means of a doctor, for instance a resilient elastic blade 6, the excess coating composition is scraped off from the web of paper. Seen in cross section (FIG. *2a*) the point of attack on the blade on the web of paper is located as close as possible to the axis of the swivel bearing 2 (this axis is referred to hereinafter as the "first swivel axis A"). In order for this swivel axis A to lie at all times unchanged in the outer surface C of the counter roller, the supporting bars 20 rest against stationary stops 60 when the apparatus is in position ready for operation. For repetitive eork, the entire apparatus can be swung around the axis X—to the left in the case of FIG. *2a*. The blade 6—seen in cross section in FIG. *2a*—is fastened at its lower end directly to the doctor supporting beam. For this purpose there can be provided a clamping ledge 8 which is only shown diagrammatically in FIG. *2a*. As shown in FIG. *2a* there is also fastened to the doctor supporting beam 5 a suporting ledge 7 which supports the blade 6 in the region between its clamping and its tip which acts on the web of paper. The customary means for fine adjustment of the supporting ledge 7 which serve to make the transverse profile of the coating uniform have been omitted.

Instead of the blade 6 one can use in known manner in the apparatus described above, a metering-rod doctor, by means of a blade-shaped resilient holder to those free end the metering rod is fastened.

The doctor supporting beam 5 is provided at each of its ends with a supporting arm 3 which extends into the region of the first swivel axis A. There each of the supporting arms 3 has a swivel bearing or journal pin trunnion 4. The axis thereof is eccentric to the first swivel axis A and is referred to subsequently as "second swivel axis Z." by means of the two journal pins 4 the doctor supporting beam 5 rests swingably in one supporting element 11 each, preferably developed as intermediate lever. Each intermediate lever 11 is mounted, for its part, by means of the aforementioned swivel bearing 2 in the adjacent supporting bar 20. The free end of each intermediate lever 11 is connected to the doctor supporting beam 5 by means of a spindle lift mechanism 10. The doctor supporting beam itself is supported via another spindle mechanism 12 in a bearing bracket 13 which is fastened to the above-mentioned connecting tube 21. The spindle lift mechanism 12 forms the swivel drive for the doctor supporting beam 5; i.e., by actuating of the spindle lifting mechanism 12 the doctor supporting beam 5 is swung around the first swivel axis A jointly with the intermediate levers 11 (see FIGS. *2b* and *2c*). In this way the basic position of the angle between the blade and the web of paper can, inter alia, be adjusted. Only the center lines of the spindle lift mechanisms 10 and 12 are shown in FIGS. *2a, 2b* and *2c*.

By a displacement of the two spindle lifting mechanisms 10 of the two intermediate levers 11 are swung without the doctor supporting beam 5 around the first swivel axis A. In this way the position of the second swivel axis Z is displaced relative to the first swivel axis A (see FIGS. *2a* and *2b*). Considered by itself, this swinging of the intermediate levers 11 has the result that the doctor supporting beam—seen in cross section—is placed, jointly with the blade clamping (8) and jointly with the supporting ledge 7, closer to the counter roller C or further from it. In this way the application force of the blade 6 against the web of paper is changed, with deformation of the blade.

As will be described in detail further below, the two spindle lift mechanisms 10 which are at all times connected with each other for rotation can in accordance with the invention be coupled by means of a clutch 36 to the spindle lift mechanism 12. In this way the swinging movements which are shown individually in FIGS. *2a, 2b* and *2c* can be superimposed on each other. In other words, actually the transition from the position shown in FIG. *2a* to the position shown in FIG. *2c* takes place directly and not via the intermediate position which is shown in FIG. *2b*.

In FIG. *2a* the blade 6 is shown in unloaded, undeformed condition. The application force of the blade against the web of paper is here approximately zero. The blade at its tip has a diagonally ground blade scraping surface which extends exactly parallel to an imaginary tangent T drawn through the first swivel axis A to the outer surface C of the counter roller. The blade 6 and the tangent T form the blade working angle k with each other. (In FIG. *2a* it is merely coincidental that the blade 6 extends parallel to the supporting bars 20. Other starting positions are, of course, also possible).

If it is desired now to increase the blade application force with deformation of the blade 6, it is necessary that the said blade working angle k remain unchanged since the said diagonally ground blade scraping surface is to remain parallel to the tangent T. Theoretically the increase in the blade application force could be effected solely by actuation of the spindle lift mechanism 10; see FIG. *2b*. In that case, however, the blade working angle would be reduced by the angular difference d to the value k'. The result would be that the blade 6 would rest with only an edge of the blade scraping surface against the web of paper. This must be avoided for the reasons which were mentioned previously. Therefore, simultaneously with the increase in the blade application force the doctor beam 5 together with the intermediate levers 11 must be swung upward around the first swivel axis A by the difference angle d (FIG. *2c*). It can be seen that in this way the blade operating angle k has again assumed the original value which it had in FIG. *2a*. As already explained, the individual movements theoretically shown in FIGS. *2a* and *2c* are actually superimposed upon each other. As a result, the blade working angle k remains completely unchanged for the entire duration of the combined movement of the doctor supporting beam 5. Therefore, during the continuing operation of the scraper apparatus one can increase or decrease the blade application force (in order to vary the thickness of the remaining coating) without the blade working angle k changing. In this way a constant high quality of the coating can be assured.

From FIG. *2a* the following can also be noted: The journal pins 4 of the intermediate levers 11 in which the doctor supporting beam 5 is suspended are so arranged that the second swivel axis Z lies in the vicinity of the plane B which is determined by the unstressed blade 6. The swivel axis Z is preferably arranged in the region of the rear of the web of paper which rests against the counter roller C. It is preferable that the second swivel axis Z lies—in the unstressed condition of the blade 6—between the said plane B and the tangent plane T. The second swivel axis Z then travels—due to the actuation of the spindle lift mechanism 10—transversely to the said plane B.

Differing from the arrangement of the second swivel axis Z which has been described above, it is also possible to arrange the second swivel axis Z in the vicinity of the line of attack of the supporting ledge 7 against the blade 6. In such case, the direction of swing of the intermediate levers 11 must be reversed as compared with the arrangement described above.

Another construction which differs even more from FIGS. 1 and *2a* to *2c* could be developed as follows: Instead of the intermediate levers 11 there could be mounted at each supporting bar in the swivel bearing 2 a disk which bears, within a slide guide, the supporting arm 3 of the doctor supporting beam 5. In this case the slide guide would have to make it possible for the doctor supporting beam 5, similar to what is shown in FIGS. *2a* and *2b*, to be again displaceable transverse to the said plane B and therefore transverse to the lengthwise direction of the blade 6. For this displacement of the doctor supporting beam 5 there would have to be provided a drive device which in its turn can be coupled via a coupling to the swivel drive 12.

In FIG. 3 there can be noted the essential parts of the spindle lift mechanisms 10 and 12 which have already been mentioned above and the corresponding drive parts. The spindle or threaded rod 12 engages into a nut 14. The latter has two journal pins 15 via which it rests in a bearing bracket 13 which is fastened to the above-mentioned connecting tube 21. The driving of the spindle 12 is effected by electric motor 30, shaft 31 and bevel gears 33 and 34 (with gear housing 32). The spindle 12 can drive via a clutch 36 the input shaft 37 of a bevel gear distributor transmission 39/41. The latter has a transmission housing 38 and two output shafts 40 which extend along the doctor supporting beam 5. On each end of the doctor supporting beam 5 there is arranged a bevel gear miter gearing 46, 47, 48 which via a Hooke's joint 49 drives the spindle or threaded rod 10. The latter engages into a fork-nut 23 which is pivotally connected to the intermediate lever 11.

Bearing brackets 43, 44 are provided on the doctor supporting beam 5. The gear housing 46 is rigidly fastened on the bearing bracket 44. On the other hand, the housing 38 of the distributor gearing 39/41 is mounted swingably on the bearing brackets 43. The spindle 12 rests against the gear housing 38 via the bevel gear 34 and via a thrust bearing 35, and said housing rests via the bearing brackets 43 on the doctor supporting beam 5. In this way a rotation of the spindle 12, as already described above, causes a swinging of the doctor supporting beam 5 around the axis A. The spindle 10 rests via the Hooke's joint 49 and via the thrust bearing 45 and furthermore via the gear housing 46 and the bearing bracket 44 against the doctor supporting beam 5. Thus a rotation of the two spindles 10 (only one of these spindles is visible in FIG. 3) causes a swinging of the intermediate levers 11 around the axis A. This is brought about by rotation of the spindle 12 with the clutch 36 engaged.

The essential parts of the lift mechanisms shown in FIG. 3 are provided with the same reference numbers as in FIG. 1 although a few unessential details are shown differently in FIGS. 1 and 3.

Figures 2A, 2B, 2C:
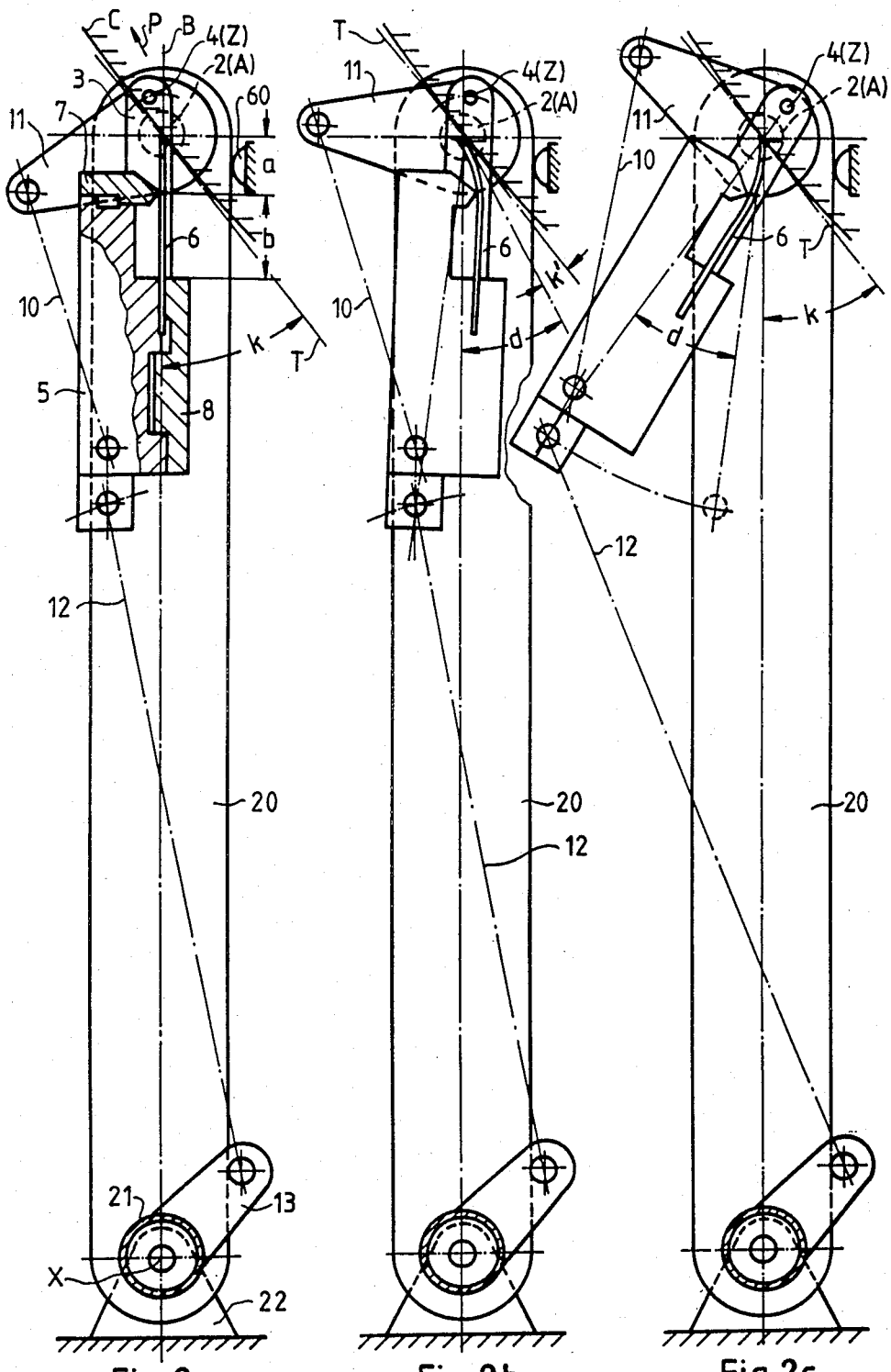

FIG. 4 shows another important development of the invention which is not shown in FIGS. 1 to 3, namely the variable linking of the lift spindle 10 to the intermediate lever 11. One can again note the fork nut 23 into which the lift spindle or threaded rod 10 engages. The intermediate lever 11 is provided, on its end that is remote from the swivel axis A, with a rectangular cutout 51 developed as slide guide, within which cutout a slide block 50 is displaceably arranged. The fork nut 23 is pivotally connected to said slide block 50 (link pin 29). In the intermediate lever 11 there is turnably mounted a threaded spindle 24 which engages into the slide block 50 and can be turned by means of a hand wheel 25. It is possible with this apparatus to change the distance between the first swivel axis A and the axis of the link pin 29.

The manner of operation of this apparatus will now be explained with reference to FIG. 5. The positions *29a* and *29b* of the link pin 29 represent the two positions of the intermediate lever 11 in FIGS. *2a* and *2b* based on a stroke s of the spindle 10.

From this swinging of the intermediate lever 11 there results a displacement of the doctor supporting beam 5 transverse to the lengthwise direction of the blade 6 (seen in cross section) by the displacement path v. At the same time, as explained above, the doctor supporting beam 5 is swung by the difference angle d. (See FIG. *2c*) The displacement path v and the difference angle d are so adapted to each other that (as also indicated above) the blade working angle k remains constant during the combined displacement movement. In the case of such adaptation there must be taken into consideration, inter alia, the dimensions a and b on the blade 6. (See FIG. 2*a*)

a is the distance from the tip of the blade to the point of attack of the supporting ledge 7 and b is the distance from there to the blade clamping device 8.

The ratio a/b can change due to wear of the point of the blade or intentionally in the manner that one shifts the point of attack of the supporting ledge 7, for instance by replacing one supporting edge by another one.

Such a change in the ratio a/b makes a new adaptation of the size ratio d/v necessary by displacement of the link pin 29, for instance, from a position 29*a* into the position 29*a'*. If the same stroke s of the spindle 10 now takes place then the link pin 29 moves into the position 29*b'*. As a result, the displacement path of the doctor supporting beam is increased to the value v'.

This change in the effective length of the intermediate lever 11 has the result that—despite the said change in the dimensional ratio a/b on the blade 6—the blade working angle k remains constant upon a change in the blade application force.

A further possible use of the apparatus according to FIGS. 4 and 5, read in conjunction with FIG. 3, will now be described. First of all, it should be mentioned that, as is known, wear of the blade by a given amount (for instance 1 mm) results in a certain reduction in the application force. From this there results an undesired increase in the thickness of the coating on the web of paper. For this reason it is attempted, in the same way as in the known scraping apparatus, to cancel out as rapidly as possible any reduction in the application force. For this purpose the motor 30 is switched on for a short time, it driving the spindle 12 and thus—with clutch 36 engaged—the two spindles 10 in such a manner that the doctor supporting beam is moved by an amount which corresponds to the wear experienced by the blade 6. For this purpose a control device can be provided which is connected with a measuring device for the thickness of the coating and which controls the motor 30 in such a manner that the thickness of the coating remains within the limit values permissible in each case. The control device can switch the motor 30 on and off at given time intervals. However, it is also possible for the control device to continuously control the speed of rotation of the motor if the latter runs continuously with very slow speed. In each case the process of stepwise or continuous follow-up of the doctor supporting beam 5 continues until the blade is completly worn out.

In connection with the above-described follow-up process the following can be done in accordance with the invention: By means of the hand wheel 25 the effective length of the intermediate lever 11 (i.e. the distance between the first swivel axis A and the axis of the link pin 29) can be so selected that the blade working angle k remains as constant as possible during its useful life. In other words, the effective length of the intermediate lever 11 is adjusted on basis of the life of the specific blade used, as learned from experience.

Another possibility of maintaining the blade application pressure constant despite the continuous wear of the blade is described below: An additional drive motor 30*a* is coupled to one of the shafts 40 (as shown in dash-dot lines in FIG. 3). With the clutch 36 released (spindle 12 stationary) this motor can drive the two spindles 10 so as to swing only the two intermediate levers 11 around the axis A. In this way, again a follow-up of the doctor supporting beam 5 is obtained without, to be sure, swinging it simultaneously around the axis A. In other words, a gradual displacement of the doctor supporting beam takes place similar to what can be noted from FIGS. 2*a* and 2*b*. In rough approximation this is a parallel displacement of the doctor supporting beam 5 in the direction towards the counter roller C. However, the blade application pressure is not increased, as has been shown in FIGS. 2*a* and 2*b*. Rather, the purpose of this displacement is now to keep the blade application force constant with due consideration of the continuous wear of the blade. The advantage of this type of follow-up of the doctor supporting beam is that the blade working angle k does not change. In other words, no special measures are necessary in order to keep the blade working angle constant. In particular, the displaceability of the effective length of the intermediate lever 11 shown in FIGS. 4 and 5 is not required.

The possibility of driving only the spindles 10 can also be used for an entirely different purpose. In this way one can displace the doctor supporting beam 5 so close in the direction towards the counter roller C that the blade working angle becomes practically zero; in other words, the blade working angle becomes even substantially smaller than the angle k' shown in FIG. 2*b*. The operation of the scraping apparatus in this condition is the so-called bent travel, also known under the name "bent blade" process; see Reference 7, FIG. 4. The construction in accordance with the invention makes it possible with the "bent blade" process to adjust the blade application pressure very precisely and to maintain the very small blade working angle precisely constant. For this purpose the method described above with reference to FIGS. 2*a* to 2*c* is used. However, one can also vary the blade application pressure by merely turning the spindles 10 (with clutch 36 released), particularly if the blade working angle is set completely equal to zero. The above-mentioned additional drive motor 30*a* is, as a rule, not necessary for the bent blade process. Rather, a hand wheel is all that is required.

I claim:

1. An apparatus for scraping off excess composition coating applied to a travelling web, the apparatus comprising:

a doctor support member and a doctor supported thereon, the doctor having a blade edge disposed transversely to the direction of travel of the web and at a predetermined angle of attack thereto;

a frame including first and second spaced supporting bars for pivotally supporting the doctor support member therebetween; and pivoting means for mounting the doctor support member to the frame, the pivoting means being adapted to enable pivoting of the doctor support member to adjust the pressure exerted by the blade on the web and to automatically and simultaneously maintain the angle of attack of the blade edge on the web at said predetermined angle irrespective of the position of the doctor support member, the pivoting means including means for pivotably supporting the pivoting means on the first and second supporting bars and being adapted to pivot the support member about a first axis which passes through the blade of the doctor and to be movable relative to the web in a manner which enables adjustment of the force applied by the blade edge on the web, the doctor support member being mounted to the pivoting means at a location thereon which coincides with the position of a second axis located parallel to but eccentrically removed from the first axis, the second axis being transferrable around the first axis.

2. The apparatus of claim 1 in which the pivoting means include:

first and second pivoting levers respectively and pivotably supported on the first and second supporting bars and pivotable about the first axis, the pivoting levers having respective distal ends at which a pivoting force may be applied;

the doctor support member being mounted to the pivoting levers at a location thereon which coincides with that of the second axis;

first driving means coupled to the pivoting levers for pivoting the pivoting lever about the first axis to control the force applied by the blade to the web and second driving means coupled to the first driving means for pivoting the doctor support member further about the first axis in a manner that maintains the predetermined angle of attack substantially constant, regardless of movement of the support member imparted by the first driving means.

3. The apparatus as in claim 2 in which the pivoting levers are connected to the supporting bars by first trunnions, the doctor support member includes supporting arms and second trunnions for connecting the supporting arms of the doctor support member to the pivoting levers, the first driving means includes a first spindle drive having a first end coupled to the doctor support member and a second end secured to the distal ends of the pivoting levers, the second driving means includes a second spindle drive connected between the frame of the apparatus and the doctor support member.

4. The apparatus as in claim 3 which comprises a supporting ledge which bears against the doctor to bend it when the doctor support member is pivoted whereby the blade edge bears against the web which in turn is backed by a counter roller.

5. The apparatus of claim 4 which includes a motor for rotating the second spindle drive.

6. The apparatus of claim 5 which includes a clutch for connecting the first and second spindle drives to each other and a gearing mechanism for transmitting rotaional movement from the second spindle drive to the first spindle drive at a given gear ratio.

7. The apparatus as in claim 5 which includes a second motor for driving the first spindle drive.

8. The apparatus as in claim 6 or 7 which includes a plurality of connection points between the first spindle drive and the pivoting levers to provide adjustable control of the moment arm on the pivoting levers.

9. The apparatus of claim 8 in which the plurality of connection points are provided by a slide guide formed in each of the supporting levers, a slide block which is displaceable along the slide guide and securable at any point therein and means for connecting the first spindle drive to the slide block.

10. The apparatus of claim 4 in which the first spindle drive includes first and second spindle members disposed proximately to and respectively associated with the first and second pivoting levers and a gearing mechanism for connecting the first and second spindle members to the first driving means.

11. The apparatus as in claim 10 in which the second spindle drive includes a nut, a spindle having a threaded end which is receivable in the nut, and means for pivotably connecting the nut to the frame, the motor driving the spindle to vary the effective length of the spindle to thereby pivot the doctor support member.

12. The apparatus of claim 11 in which the first spindl drive includes a double gear arrangement coupled at one end to the spindle of the second spindle drive and at another end thereof to the first spindle drive to transmit rotation of the second spindle to the first spindle drive, the first and second spindle members of the first spindle drive having a threaded section which is threadedly received in a respective threaded fork nut which is, in turn, pivotably connected to a respective one of the pivoting levers.

* * * * *